US008992271B2

(12) United States Patent
Harasawa et al.

(10) Patent No.: US 8,992,271 B2
(45) Date of Patent: Mar. 31, 2015

(54) ELECTRICAL TERMINAL

(71) Applicant: Tyco Electronics Japan G.K., Kanagawa-ken (JP)

(72) Inventors: Masaaki Harasawa, Kanagawa-ken (JP); Ken Sakai, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 24 days.

(21) Appl. No.: 13/955,329

(22) Filed: Jul. 31, 2013

(65) Prior Publication Data

US 2014/0038475 A1 Feb. 6, 2014

(30) Foreign Application Priority Data

Jul. 31, 2012 (JP) ..... 2012-169949

(51) Int. Cl.

| | |
|---|---|
| ***H01R 4/24*** | (2006.01) |
| ***H01R 4/10*** | (2006.01) |
| ***H01R 4/50*** | (2006.01) |
| *H01R 13/629* | (2006.01) |

(52) U.S. Cl.

CPC ..... *H01R 4/10* (2013.01); *H01R 4/5008* (2013.01); *H01R 4/5041* (2013.01); *H01R 4/5075* (2013.01); *H01R 13/62927* (2013.01)

USPC ..... 439/879; 439/421

(58) Field of Classification Search

USPC ..... 439/879, 421, 442, 882

See application file for complete search history.

(56) References Cited

U.S. PATENT DOCUMENTS

| | | | | | |
|---|---|---|---|---|---|
| 2,376,861 | A | * | 5/1945 | Friedrich | 439/879 |
| 2,788,508 | A | * | 4/1957 | Buchanan | 439/879 |
| 2,815,497 | A | * | 12/1957 | Redslob | 439/203 |
| 3,138,658 | A | * | 6/1964 | Weimer, Jr. | 174/94 R |
| 3,428,740 | A | * | 2/1969 | Wayboer | 174/94 R |
| 3,852,702 | A | | 12/1974 | Dowling | |

(Continued)

FOREIGN PATENT DOCUMENTS

| | | |
|---|---|---|
| DE | 3518229 A1 | 11/1986 |
| JP | 52-114987 | 9/1977 |

(Continued)

OTHER PUBLICATIONS

European Search Report, Application No. 13178250.0-1801, dated Nov. 17, 2014, 8 pages. Abstract of DE3518229, published Nov. 27, 1986, 1 page.

*Primary Examiner* — Gary Paumen

(74) *Attorney, Agent, or Firm* — Barley Snyder

(57) ABSTRACT

An electrical terminal is provided and includes a first member and a second member. The first member includes a pair of connecting face portions, a coupling portion, and a plurality of serrations. The pair of connecting face portions face each other in a substantially V shape such that a gap between inner faces of the pair of connecting face portions gradually becomes smaller from a wider-gap side to a narrower-gap side. The coupling portion connects the pair of connecting face portions at ends of the narrower-gap side of the inner faces. The plurality of serrations are disposed on the pair of inner faces and extend along intersecting directions. The second member has a substantially U shape that mates with the pair of connecting face portions and can displace outer side faces of the pair of connecting face portions inward to urge the inner faces closer to each other.

14 Claims, 12 Drawing Sheets

(56) References Cited

U.S. PATENT DOCUMENTS

| | | | | |
|---|---|---|---|---|
| 3,892,459 | A * | 7/1975 | Dittmann et al. | 439/442 |
| 4,003,623 | A | 1/1977 | Reynolds | |
| 5,035,655 | A * | 7/1991 | Hesse | 439/699.2 |
| 6,056,605 | A | 5/2000 | Nguyen et al. | |
| 6,749,457 | B2 * | 6/2004 | Sakaguchi et al. | 439/421 |
| 2007/0077814 | A1 | 4/2007 | Sullivan et al. | |
| 2007/0287323 | A1 * | 12/2007 | Colescott et al. | 439/421 |

FOREIGN PATENT DOCUMENTS

| | | |
|---|---|---|
| JP | 10-199590 | 7/1998 |
| JP | 10-302857 | 11/1998 |
| JP | 2001-185251 | 6/2001 |
| JP | 2003-086264 | 3/2003 |
| WO | 8707773 A1 | 12/1987 |

* cited by examiner

ELECTRICAL TERMINAL

CROSS-REFERENCE TO RELATED APPLICATIONS

This application claims the benefit of the filing date under 35 U.S.C. §119(a)-(d) of Japanese Patent Application No. 2012-169949 of Jul. 31, 2012.

FIELD OF THE INVENTION

The present invention relates to an electrical terminal and, in particular, to an electrical connector for connection with a thin wire.

BACKGROUND

A known electrical terminal 101 for connection with a wire is disclosed in U.S. Pat. No. 4,003,623 B and shown in FIGS. 11 and 12.

The known electrical terminal 101 shown in FIG. 11 includes a pair of side walls 104, 105 that extend from opposite sides of a base 103 and face each other. The shown embodiment is substantially U-shaped and includes a cavity 102 therein. The electrical terminal 101 is made by stamping and forming a metal sheet. The base 103 has an elongated shape for receiving wires W1 and W2 (see FIG. 12). A plurality of serrations 106 are successively positioned from the upper end of the one side wall 104 to the upper end of the other side wall 105 and disposed along the inner surfaces of the pair of side walls 104, 105 and the base 103. Hence, the serrations 106 formed on the side wall 104 and the serrations 106 formed on the side wall 105 are opposed each other and extend in the same direction. Each of the serrations 106 extends in a direction perpendicular to a length of the base and a direction in which the wires W1 and W2 (see FIG. 12) extend when positioned in the cavity 102.

After the two wires W1 and W2 are inserted into the cavity 102, the pair of side walls 104 and 105 are deformed, as shown in FIG. 12, to crimp the electrical terminal 101 onto the wires W1 and W2. Then, the side wall 104 wraps around the periphery of the wire W1, while the side wall 105 wraps around the wire W2. In this situation, each serration 106 bites into the wires W1 and W2.

Another known electrical connector 201 for connection with a thin wire like a coil winding is disclosed in Japanese Patent No. JP S52-114987 A, as shown in FIG. 13

As shown, the known electrical connector 201 includes a housing 210 having a terminal receiving section 211 and an electrical terminal 220 for insertion into the terminal receiving section 211.

First grooves 212 are disposed along both upper sides of the terminal receiving section 211 of the housing 210. Second grooves 213 are disposed along both lower sides of the terminal receiving section 211 of the housing 210. In addition, a wire wound section 215 is provided at a back side of an upper wall 214 of the housing 210, in order to wind a wire 216 around the wire wound section 215. The wire 216 is a thin electrical insulated wire of, for example, approximately A.W.G #50 having a metal core and an insulator covering the outer part of the metal core.

On the other hand, the electrical terminal 220 is made by stamping and forming a metal sheet, and includes a base 221 having a substantially rectangular flat plate shape. A plurality of lances 221*a* and 221*b* are positioned along opposites sides of the base 221. Moreover, the electrical terminal 220 is provided with a front side plate 222 extending obliquely forward from the front end of the base 221 and a back side plate 224 extending from the back end of the base 221 to be folded back obliquely. A side plate 223 extends in such a manner as to be folded back backward from a tip 222*a* of the front side plate 222. A plurality of serrations 225 are disposed on the surface of the side plate 223. The end of back side plate 224 is positioned between a pair of flanges 223*a* positioned at both sides of the side plate 223 and folded downward there from. Lances 223*b* are provided at ends of the pair of flanges 223*a*, respectively.

Then, the electrical terminal 220 is inserted into the terminal receiving section 211 of the housing 210. Accordingly, the base 221, the front side plate 222, the side plate 223, and the back side plate 224 are inserted into the terminal receiving section 211. Additionally, the lances 223*b* are pressed into the first grooves 212, respectively, and the lances 221*a* and 221*b* are pressed into the second grooves 213, respectively. Moreover, when the tip 222*a* of the front side plate 222 abuts against an end wall, not shown, of the housing 210, the base 221 is moved in the direction of an arrow, and then the front side plate 222 is turned around a fixed end thereof. Accordingly, each of the serrations 225 formed on the side plate 223 engages the wire 216.

Furthermore, another example of a known electrical connector for connection with a thin wire like a coil winding is disclosed in Japanese Patent No. JP H10-302857 A, as shown in FIG. 14.

The known electrical connector 301 shown in FIG. 14 includes a housing 310, a first terminal 320 press-fitted into a first cavity 311 of the housing 310, and a second terminal 330 press-fitted into a second cavity 312 of the housing 310.

The first terminal 320 is made by stamping and forming a metal sheet, and includes a base 324 press-fitted into the first cavity 311, and a contact part 321 having a gently arcuate shape curved toward a wire receiving surface 313 of the housing 310. A plurality of serrations 322 are disposed on a surface of the contact part 321 and positioned opposite to the wire receiving surface 313. A vertex 323 is formed at the end of the first terminal 320 at the contact part 321 side.

Furthermore, the second terminal 330 is made by stamping and forming a metal sheet, and has a pressing part 331 disposed at the tip thereof to press the vertex 323 of the first terminal 320 toward the wire receiving surface 313.

Then, a wire 330 is disposed between the wire receiving surface 313 and the contact part 321. When the second terminal 330 is press-fitted, the pressing part 331 of the second terminal 330 presses the vertex 323 of the first terminal 320 toward the wire receiving surface 313. This permits the contact part 321 of the first terminal 320 to elastically contact with the wire 330. When the contact part 321 elastically contacts the wire 330, the serrations 322 formed on the contact part 321 engage the wire 330. The wire 330 is a thin insulated electrical wire of, for example, approximately A.W.G #50 having a metal core and an insulator covering the outer part of the metal core Each of the known electrical terminals 101, 201 and 301 have the following disadvantages.

As for the known electrical terminal 101 shown in FIG. 11 and FIG. 12, the cavity 102 that receives the wires W1 and W2 is large, notably when a thin wire like a coil winding is connected. The pair of side walls 104 and 105 are not completely rounded and some portions remain. This makes it difficult to connect such a thin wire in a stable manner, especially when a single thin wire is connected. Herein, the thin wire denotes a wire having a diameter of for example, approximately 0.02 mm to 0.25 mm.

As for the known electrical connector 201 shown in FIG. 13, it is difficult to narrow the pitch of the base 221, the side plate 223, and the like of the electrical terminal 220 that have a wide width. Furthermore, the housing 210 is necessary in addition to the electrical terminal 220 to connect the wire 216, thereby posing a problem that the number of component parts is large.

As for the electrical connector 301 shown in FIG. 14, the wire 301 for connection is the thin insulated electrical wire of, for example, approximately A.W.G #50 including the metal core and the insulator covering the outer part of the metal core. Therefore, stable connection can be achieved when the thin wire like the coil winding is connected. However, the housing 310 is necessary in addition to the first and second terminals 320 and 330 to connect the wire 301, thereby posing a problem that the number of component parts is large.

SUMMARY

Accordingly, the present invention has been made in view of the aforementioned disadvantages and shortcoming, and it is an object of the present invention, among others to provide having a first member and a second member. The first member includes a pair of connecting face portions, a coupling portion, and a plurality of serrations. The pair of connecting face portions face each other in a substantially V shape such that a gap between inner faces of the pair of connecting face portions gradually becomes smaller from a wider-gap side to a narrower-gap side. The coupling portion connects the pair of connecting face portions at ends of the narrower-gap side of the inner faces. The plurality of serrations are disposed on the pair of inner faces and extend along intersecting directions. The second member has a substantially U shape that mates with the pair of connecting face portions and can displace outer side faces of the pair of connecting face portions inward to urge the inner faces closer to each other.

BRIEF DESCRIPTION OF THE DRAWINGS

The objects, features and advantages of the invention will become more apparent by describing in detail embodiments thereof with reference to the accompanying drawings, in which.

DETAILED DESCRIPTION OF THE EMBODIMENT(S)

Figure 1:
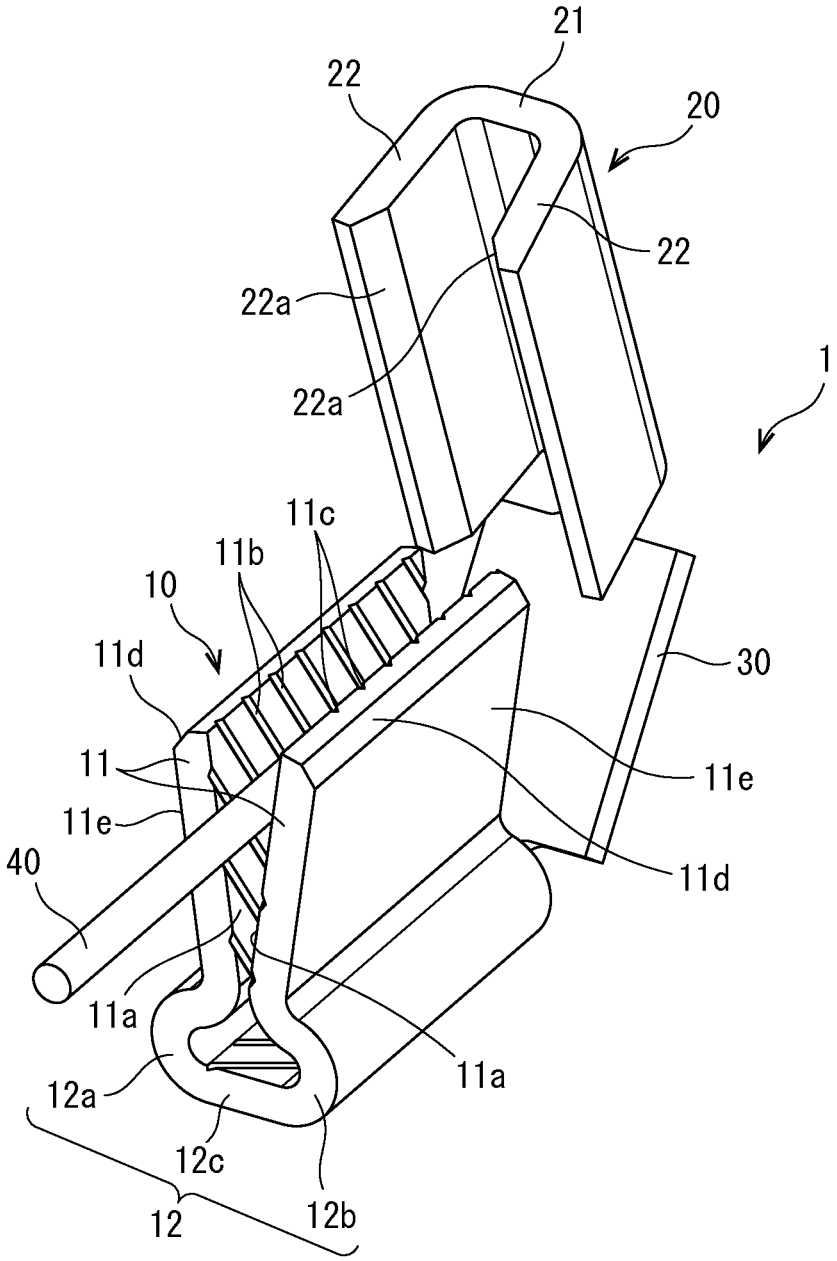
FIG. 1 is a perspective view of an electrical terminal according to the invention.

Hereinafter, embodiments of the present invention will be described with reference to the drawings.

With reference to FIGS. 1 through 6, an electrical terminal 1 according to the invention will be described. A thin wire 40, such as a coil winding, is connected to the electrical terminal 1. The thin wire 40 is, for example, an electrical insulated wire having a metal core and an insulator covering the outer part of the metal core and having a diameter of approximately 0.02 mm to 0.25 mm, or a metal core having a diameter of approximately 0.02 mm to 0.25 mm. An example of the electrical insulated wire is a magnet wire. Hereinafter, an example of the magnet wire used as the wire 40 will be described.

The electrical terminal 1 shown in FIG. 1 to FIG. 6 is made by stamping and forming a metal sheet and includes a first member 10, a second member 20, and a coupling member 30 for coupling the first member 10 with the second member 20.

The first member 10 includes a pair of connecting face portions 11 and a coupling portion 12 that connects the pair of connecting face portions 11.

Figure 3:
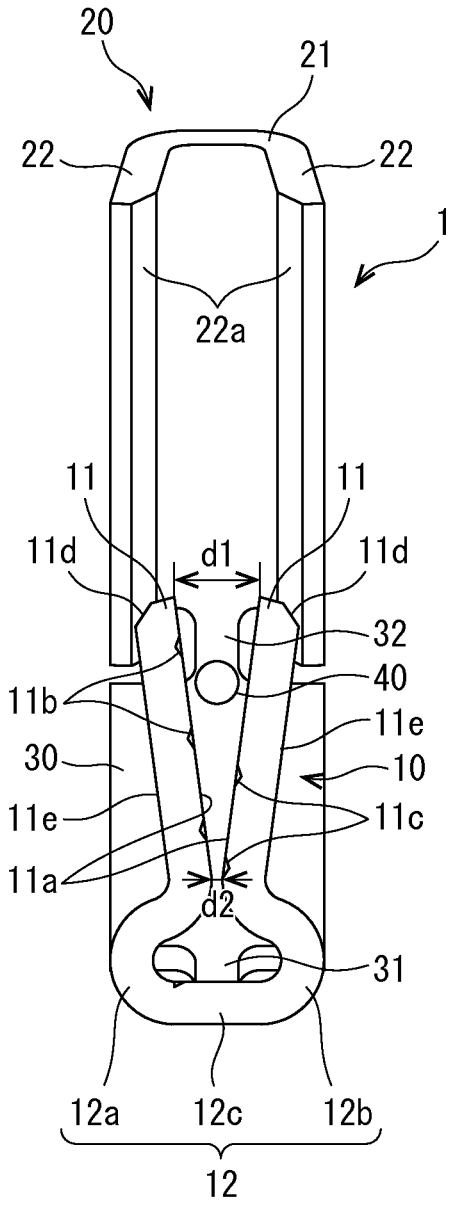
FIG. 3 is a front view the electrical terminal according to the present invention and a state before the second member is mated with the first member.

The pair of connecting face portions 11 face with each other, and are formed in a substantially V shape, in the embodiment shown, such that a gap between inner faces 11*a* facing with each other is gradually smaller from a wider-gap side to a narrower-gap side. Each connecting face portion 11 is plate shapes. Upper ends of the pair of connecting face portions 11 have a wider gap between the inner faces 11*a* that the lower ends of the pair of connecting face portions 11, which have a narrower gap there between. As shown in FIG. 3, as to the gaps between the inner faces 11*a* of the pair of connecting face portions 11 facing with each other, a width d1 represents a wider-gap side and a width d2 represents a narrower-gap side. The width d1 is set to be larger than the diameter of the wire 40, whereas the width d2 is set to be smaller than the diameter of the wire 40. Additionally, the pair of connecting face portions 11 are formed in such a manner that the inner faces 11*a* facing with each other are curved outward from the narrower-gap side to the wider-gap side.

Figure 7A:
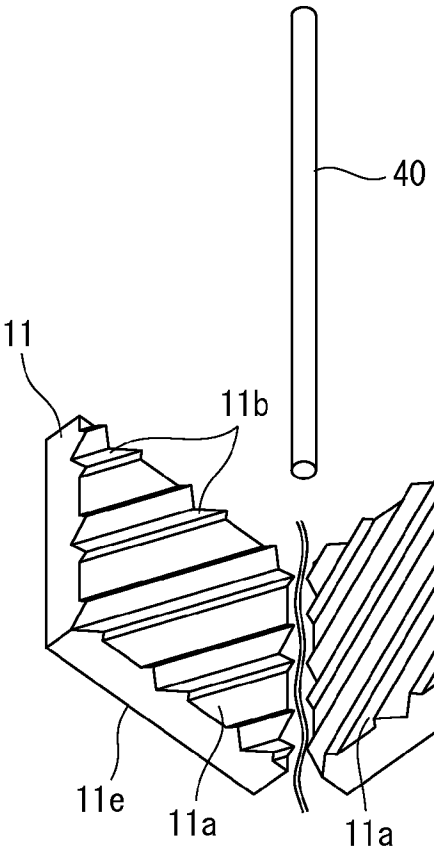
FIG. 7A is a schematic diagram showing a wire being connected with the pair of connecting face portions.
Figure 7B:
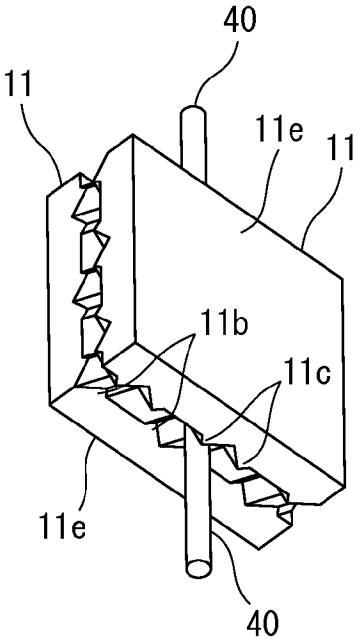
FIG. 7B is a schematic diagram showing the wire in FIG. 7A being connected with the pair of connecting face portions.
Figure 7C:
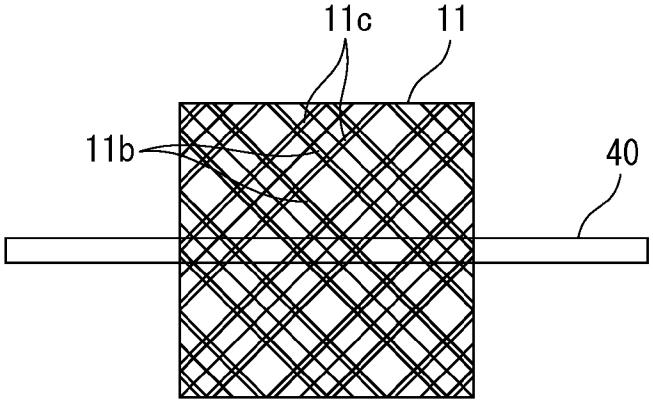
FIG. 7C is a schematic diagram showing the wire of FIG. 7B being connected with the pair of connecting face portions and a plurality of serrations intersecting with each other.

The pair of connecting face portions 11 receives the wire 40 from the wider-gap side of the inner faces 11*a* facing with each other, and hold the wire with the inner faces 11*a* facing with each other. A plurality of serrations 11*b* and 11*c* are provided. In the shown embodiment, the plurality of serrations 11*b* and 11*c* extend in a direction in which the axial line of the received wire 40 extends, i.e., in a direction intersecting with the front-back direction on the inner faces 11*a* of the pair of connecting face portions 11 facing with each other. As shown in FIG. 7A, FIG. 7B, and FIG. 7C, the plurality of serrations 11*b* and 11*c* are disposed along the inner faces 11*a* of the pair of connecting face portions 11 facing with each other extend in directions intersecting with each other.

The coupling portion 12 connects the pair of connecting face portions 11 at the ends of the narrower-gap side, which is the lower ends, of the inner faces 11*a* facing with each other. As illustrated in FIG. 3, the coupling portion 12 includes a first curved portion 12*a* curved outward from the lower end of one of the pair of connecting face portions 11, a second curved portion 12*b* curved outward from the lower end of the other of the connecting face portion 11, and a connecting portion 12*c* for connecting the end of the first curved portion 12*a* with the end of the second curved portion 12*b*.

Figure 4:
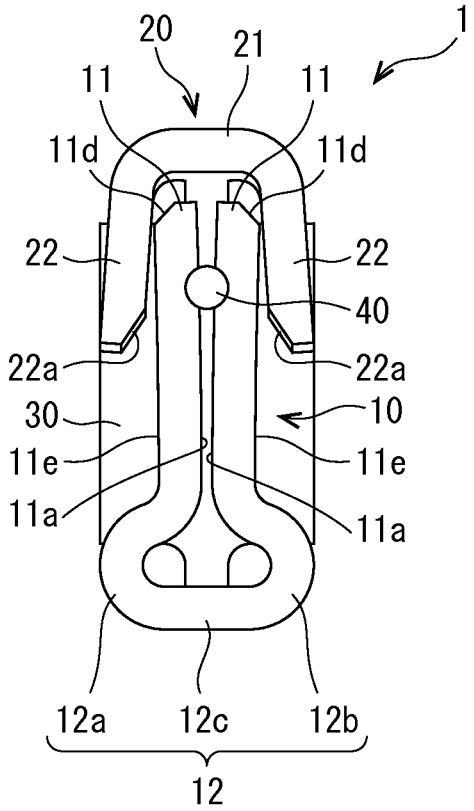
FIG. 4 is a front view of the electrical terminal according to the invention when the second member is mated with the first member after the wire is inserted into the first member.
Figure 6:
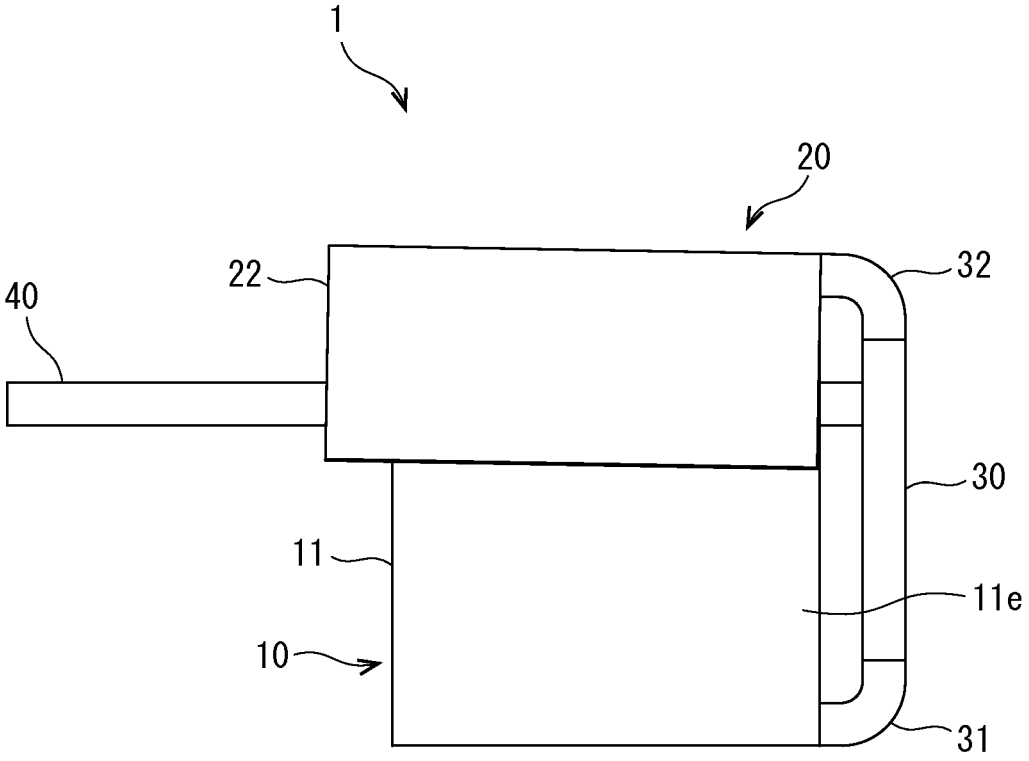
FIG. 6 is a right side view of the electrical terminal according to the invention and after the second member is mated with the first member after the wire is inserted into the first member.

Moreover, the second member 20 is substantially U shaped in the shown embodiment. The second member 20 includes a flat plate portion 21 having a substantially rectangular shape that extends in the front-back direction, and a pair of side plates 22 extending downward from both ends of the flat plate portion 21 in the width direction. As shown in FIG. 4 and FIG. 6, the second member 20 is mated with the pair of connecting face portions 11 from the wider-gap side of the inner faces 11*a* of the pair of connecting face portions 11 facing with each other. The pair of side plates 22 of the second member 20 displaces inward both outer side faces 11*e* of the pair of connecting face portions 11 to urge the inner faces 11*a* of the pair of connecting face portions 11 facing with each other closer together. Accordingly, the plurality of serrations 11*b* and 11*e* engage the wire 40, and the wire 40 is connected with the pair of connecting face portions 11.

Tapered portions 11*d* and 22*a* for guiding each other are respectively arranged on the outer faces of the ends of the pair of connecting face portions 11 on the wider-gap side of the inner faces 11*a* facing with each other, and on the inner faces of the ends of the pair of side plates 22 of the second member 20.

In the shown embodiment, the coupling member 30 is substantially rectangular flat plate, and is connected to the connecting portion 12*c* of the coupling portion 12 through a first coupling piece 31 coupled with the lower end of the flat plate, and is also coupled with the flat plate portion 21 of the second member 20 through a second coupling piece 32 coupled with the upper end of the flat plate.

A method of connecting the wire 40 with the electrical terminal 1 configured as described above will be described with reference to FIGS. 1 to 7.

Figure 5:
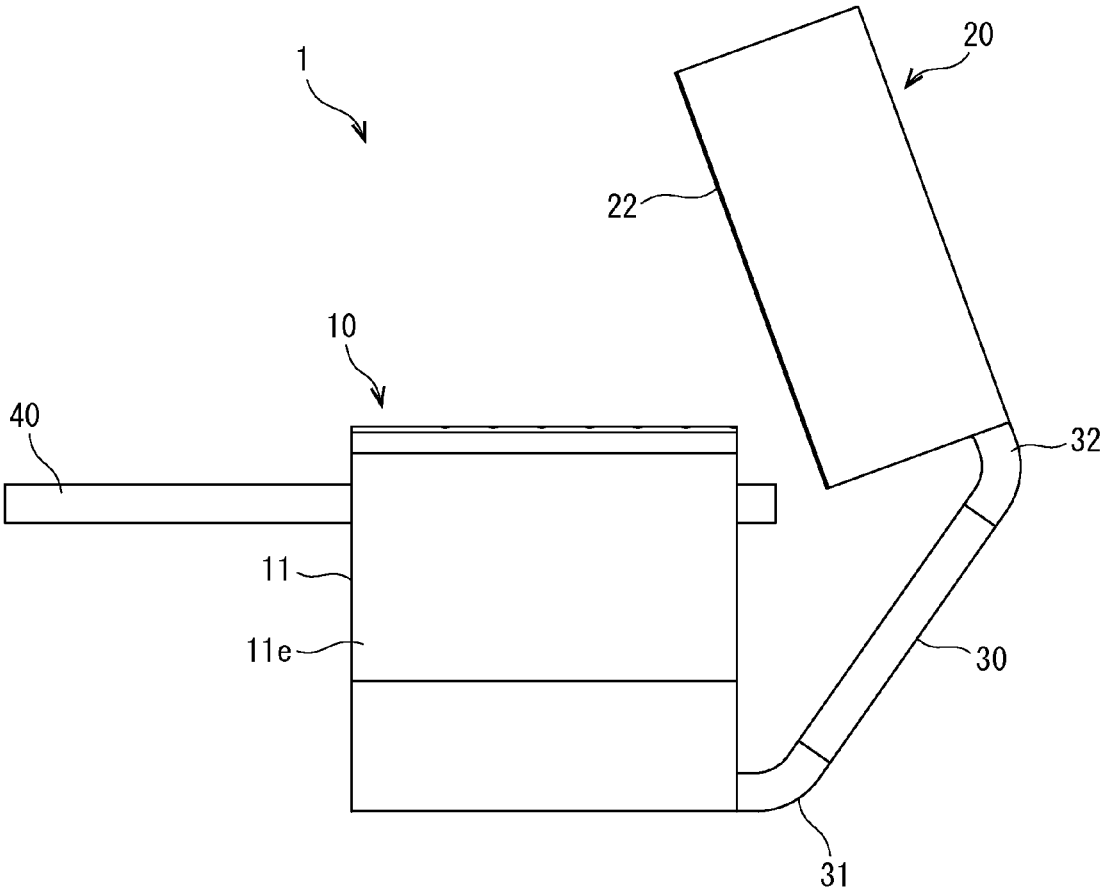
FIG. 5 is a right side view the electrical terminal according to the invention and before the second member is mated with the first member.

Firstly, as shown in FIG. 1, FIG. 3 and FIG. 5, the second member 20 is spaced apart from the first member 10, and the wire 40 is inserted from the wider-gap side of the inner faces 11*a* of the pair of connecting face portions 11 facing each other. Accordingly, the wire 40 is secured between the inner faces 11*a* of the pair of connecting face portions 11. As to the gap between the inner faces 11*a*, d1 represents the gap of the wider-gap side and d2 represents the gap of the narrower-gap side. Moreover, since the width d1 of the wider-gap side is larger than the diameter of the wire 40, it is possible to insert the wire 40 with ease from the wider-gap side of the inner faces 11*a* of the pair of connecting face portions 11 facing with each other. Furthermore, since the width d2 of the narrower-gap side is set to be smaller than the diameter of the wire 40, it is possible to hold the wire 40 with certainty between the inner faces 11*a* of the pair of connecting face portions 11 facing with each other.

Figure 2:
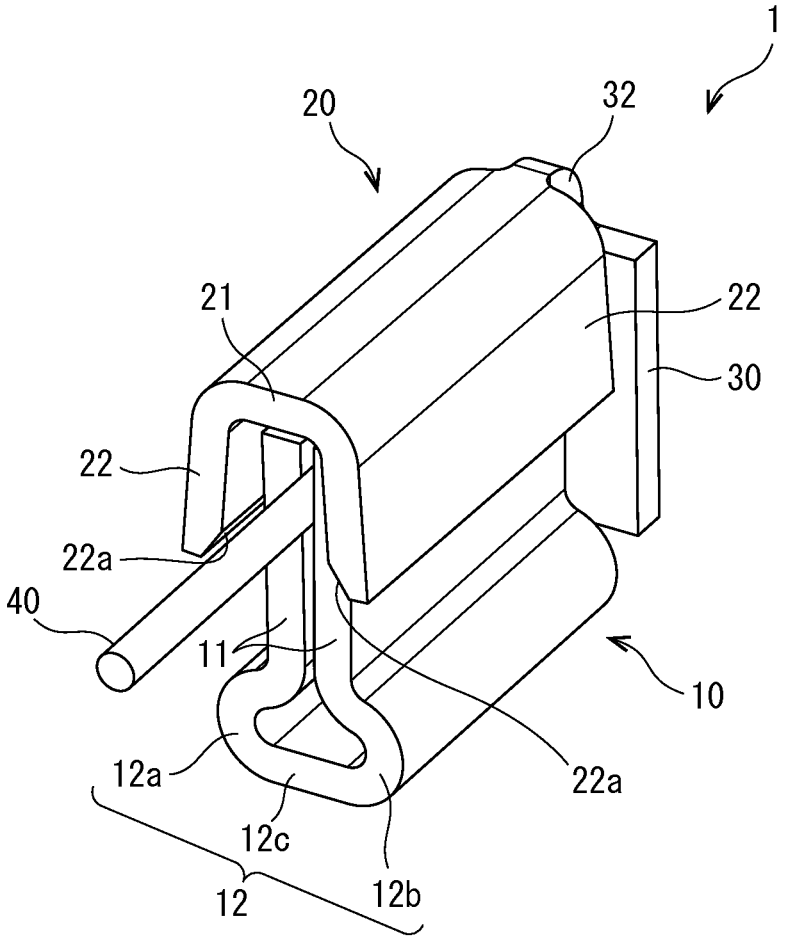
FIG. 2 is a perspective view of the electrical terminal shown in FIG. 1, showing a second member mated with a first member after a wire is inserted into the first member.

Next, as illustrated in FIG. 2, FIG. 4 and FIG. 6, the second member 20 is mated with the pair of connecting face portions 11 from the wider-gap side of the inner faces 11*a*. Then, the inner side faces of the pair of side plates 22 displace both outer side faces 11*e* of the pair of connecting face portions 11 inward. In more detail, while the inner side faces of the pair of side plates 22 move downward, the inner side faces push the upper-end outer side faces 11*e* of the pair of connecting face portions 11 inward. Accordingly, both outer side faces 11*e* displace in such a manner as to rotate inward around the lower ends (the ends on the narrower-gap side) of the pair of connecting face portions 11. As a result, the inner faces 11*a* of the pair of connecting face portions 11 rotate inward around the lower ends of the pair of connecting face portions 11, and are urged closer to each other. This causes the plurality of serrations 11*b* and 11*c* formed on the inner faces 11*a* bite into the wire 40, and thus the wire 40 is connected with the pair of connecting face portions 11. When the plurality of serrations 11*b* and 11*c* bite into the wire 40, the insulator covering the outer part of the wire 40 is deformed and then the plurality of serrations 11*b* and 11*c* are electrically connected with the metal core of the wire 40.

In this manner, by mating the second member 20 with the pair of connecting face portions 11 of the first member 10, the inner faces 11*a* are made to move closer to each other. Accordingly, the plurality of serrations 11*b* and 11*c* bite into the wire 40 to connect the wire 40 with the pair of connecting face portions 11. Hence, even if the thin wire 40 like a coil winding is connected, it is possible to connect the wire 40 in a stable manner without any remaining portion of the pair of connecting face portions 11. In particular, this advantage is remarkable when the single thin wire 40 is used for connection. It is noted that when the wire 40 of the same diameter is used for connection, the two wires 40 may be connected.

Moreover, the second member 20 displaces both outer side faces 11*e* inward to make the inner faces 11*a* closer to each other and connect the wire 40 with the pair of connecting face portions 11. Accordingly, when a plurality of electrical terminals 1 are arranged in a direction in which the pair of connecting face portions 11 face with each other, it is possible to achieve the narrower pitch.

Furthermore, since the wire 40 can be connected only by the first member 10 and the second member 20 constituting the electrical terminal 1, the wire 40 can be connected using the electrical terminal 1.

In the shown embodiment, the pair of connecting face portions 11 are formed in such a manner that the inner faces 11*a* are curved outward from the narrower-gap side of the inner faces 11*a* facing with each other to the wider-gap side. Hence, when the inner faces 11*a* of the pair of connecting face portions 11 rotate inward around the lower ends (the ends on the narrower-gap side) of the pair of connecting face portions 11 and come closer to each other, the ends of the inner faces 11*a* on the wider-gap side do not come in contact with each other before the wire 40 is connected. Accordingly, by managing the gap between the ends of the inner faces 11*a* facing with each other on the wider-gap side, it is made possible to determine whether or not the wire 40 is connected.

The tapered portions 11*d* and 22*a* for guiding each other are arranged on the outer faces of the ends of the pair of connecting face portions 11 respectively, on the wider-gap side of the inner faces 11*a*, and on the inner faces of the ends of the second member 20. Accordingly, when the second member 20 is mated with the pair of connecting face portions 11 from the wider-gap side of the inner faces 11*a*, mating is accomplished.

Figure 8A:
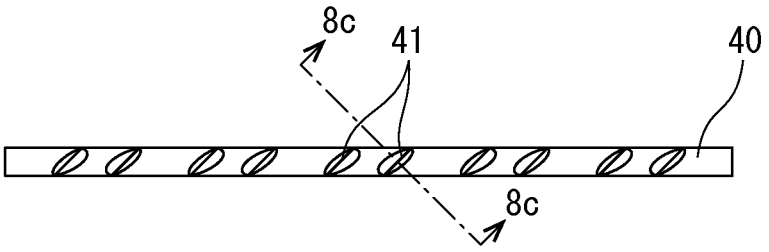
FIG. 8A is a partial front view of the wire of FIG. 7A that was connected with the pair of connecting face portions.
Figure 8B:
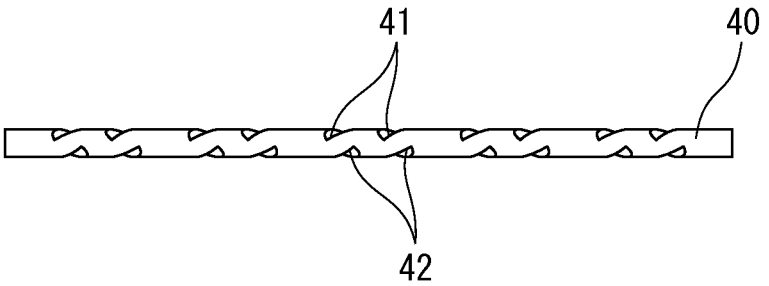
FIG. 8B is a partial plan view of the wire of FIG. 7A that was connected with the pair of connecting face portions.
Figure 8C:
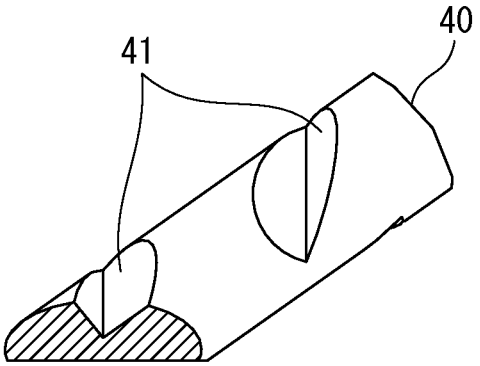
FIG. 8C is a cross-sectional view taken along a line 8C-8C in FIG. 8A.

Additionally, the plurality of serrations 11*b* and 11*c*, respectively formed on the inner faces 11*a*, extend in directions intersectional to each other, as shown in FIG. 7A, FIG. 7B and FIG. 7C. Accordingly, when the plurality of serrations 11*b* and 11*c* are electrically connected with the metal core of the wire 40, dents 41 are formed on the wire 40 by the plurality of serrations 11*b*, as shown, the dents 42 intersect to each other, as shown in FIG. 8A, FIG. 8B, and FIG. 8C. When the dents 41 and 42 are arranged to intersect each other, the areas of thinned portions are smaller than that of the case where the dents 41 and 42 are opposed to each other and extend in the same direction. In the shown embodiment, the dents 41 and 42 are arranged to intersect each other, which makes the areas of thinned portions small. Therefore, even if the wire 40 is thin like a coil winding, the wire is hardly disconnected.

In addition, according to the electrical terminal 1, the coupling portion 12 of the first member 10 and the second member 20 are coupled by the coupling member 30. This means that the first member 10 and the second member 20 are not separated. Therefore, as there is no possibility that one of the first member 10 and the second member 20 is lost, it is possible to manage the components with ease. Moreover, as the electrical terminal 1 is integrally formed, it is unnecessary to separately manufacture the first member 10 and the second member 20, and it is possible to produce the electrical terminal 1 at low cost.

Furthermore, the coupling portion 12 includes the first curved portion 12*a* curved outward from the lower end of the one connecting face portion 11, the second curved portion 12*b* curved outward from the lower end of another connecting face portion 11, and the connecting portion 12*c* for connecting the end of the first curved portion 12*a* with the end of the second curved portion 12*b*. Hence, it becomes possible to connect the connecting portion 12*c* to a metal carrier strip (not shown) through a coupling piece (not shown). In addition, as the coupling portion 12 includes the first curved portion 12*a* and the second curved portion 12*b*, it is possible to relieve stress along the lower ends of the pair of connecting face portions 11, when the inner faces 11*a* rotate inward around the lower ends of the pair of connecting face portions 11 and come closer to each other.

Next, an electrical terminal according to another embodiment of the invention will be described with reference to FIG. 9 and FIG. 10.

Figure 9:
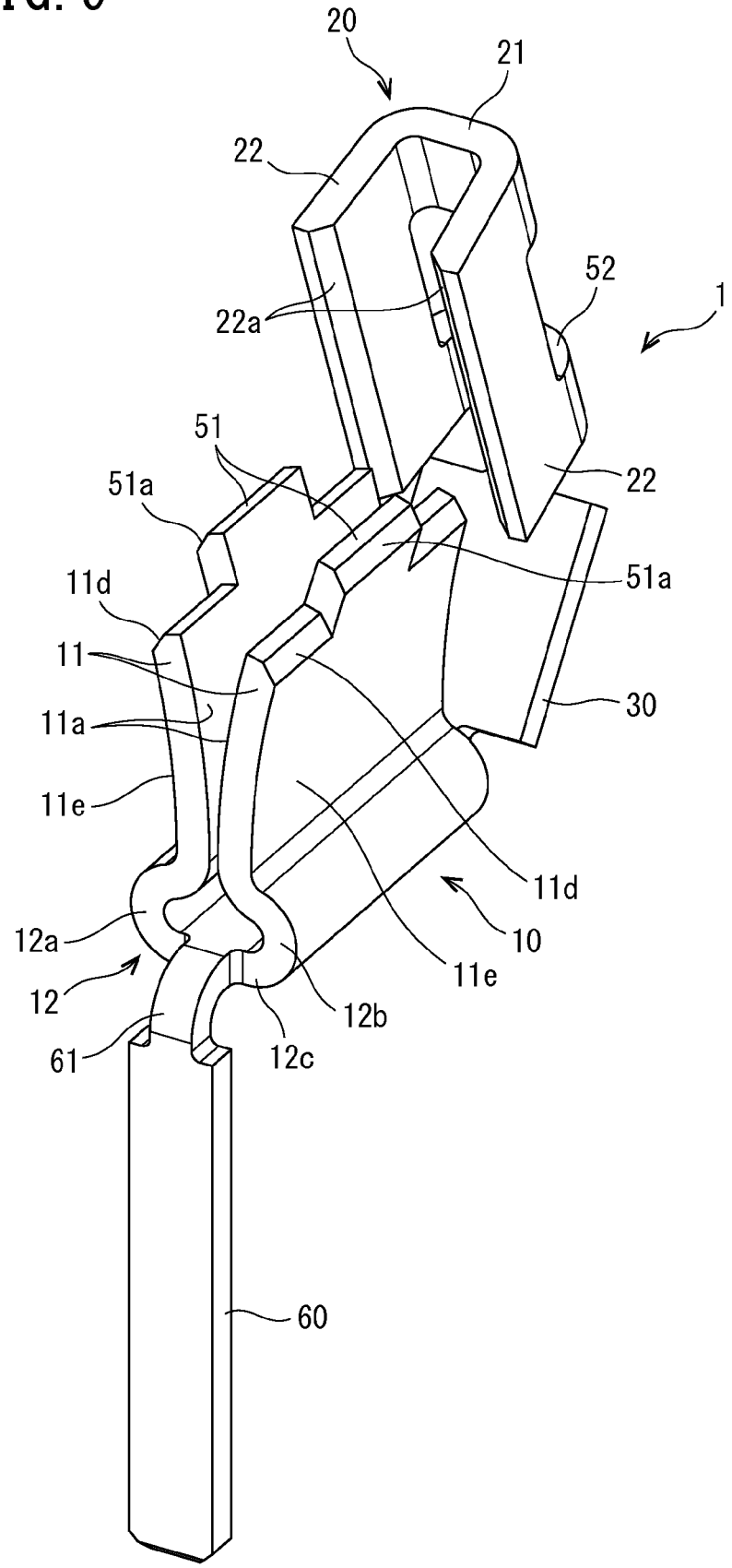
FIG. 9 is a perspective view another electrical terminal according to the invention and before a second member is mated with a first member.
Figure 10:
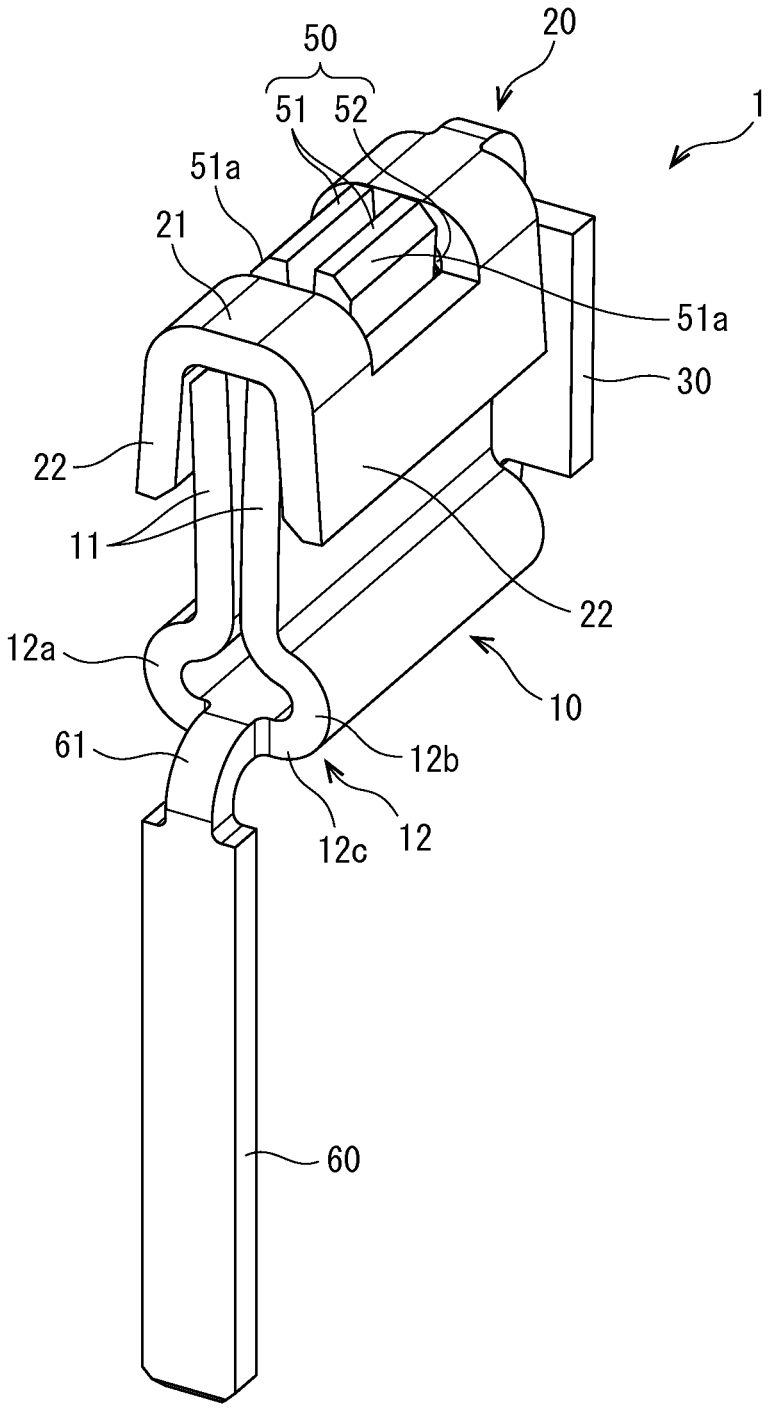
FIG. 10 is a perspective view the electrical terminal shown in FIG. 9 after the second member is mated with the first member.
Figure 11:
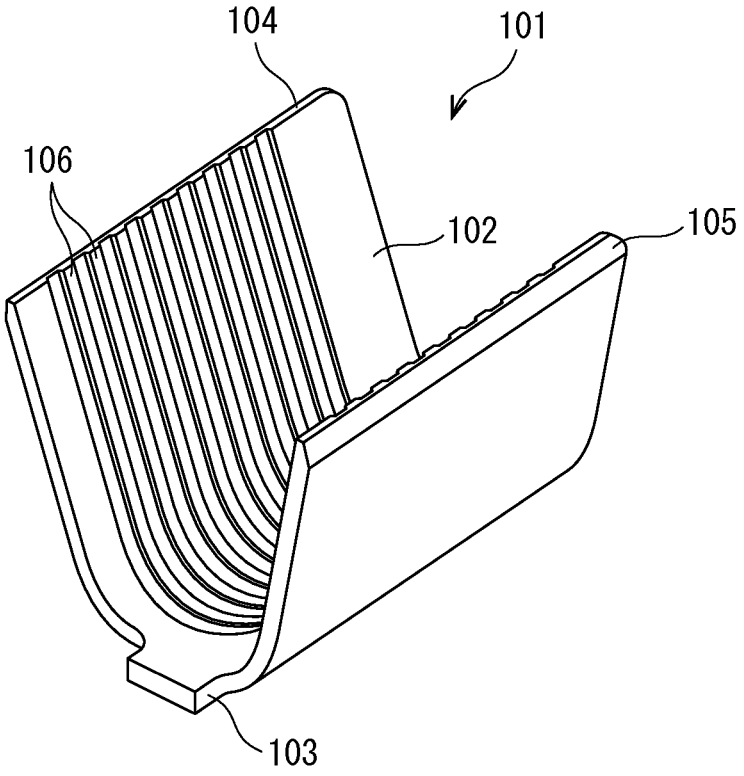
FIG. 11 is a perspective view of a known electrical terminal.
Figure 12:
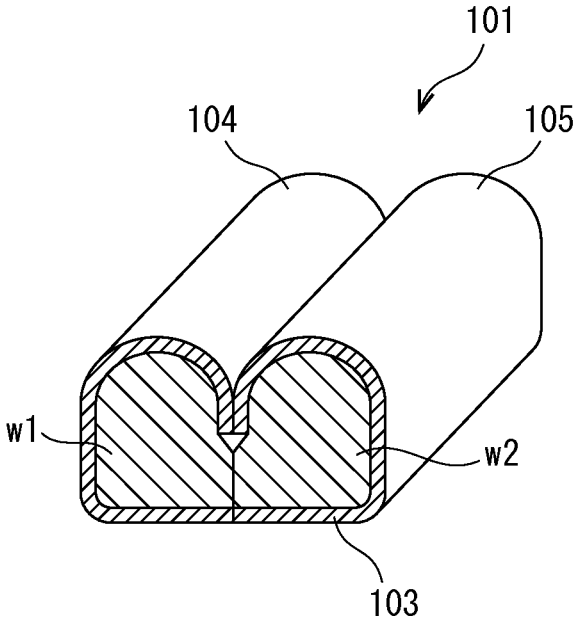
FIG. 12 is an schematic diagram showing two wires that are connected with the known electrical terminal shown in FIG. 11.
Figure 13:
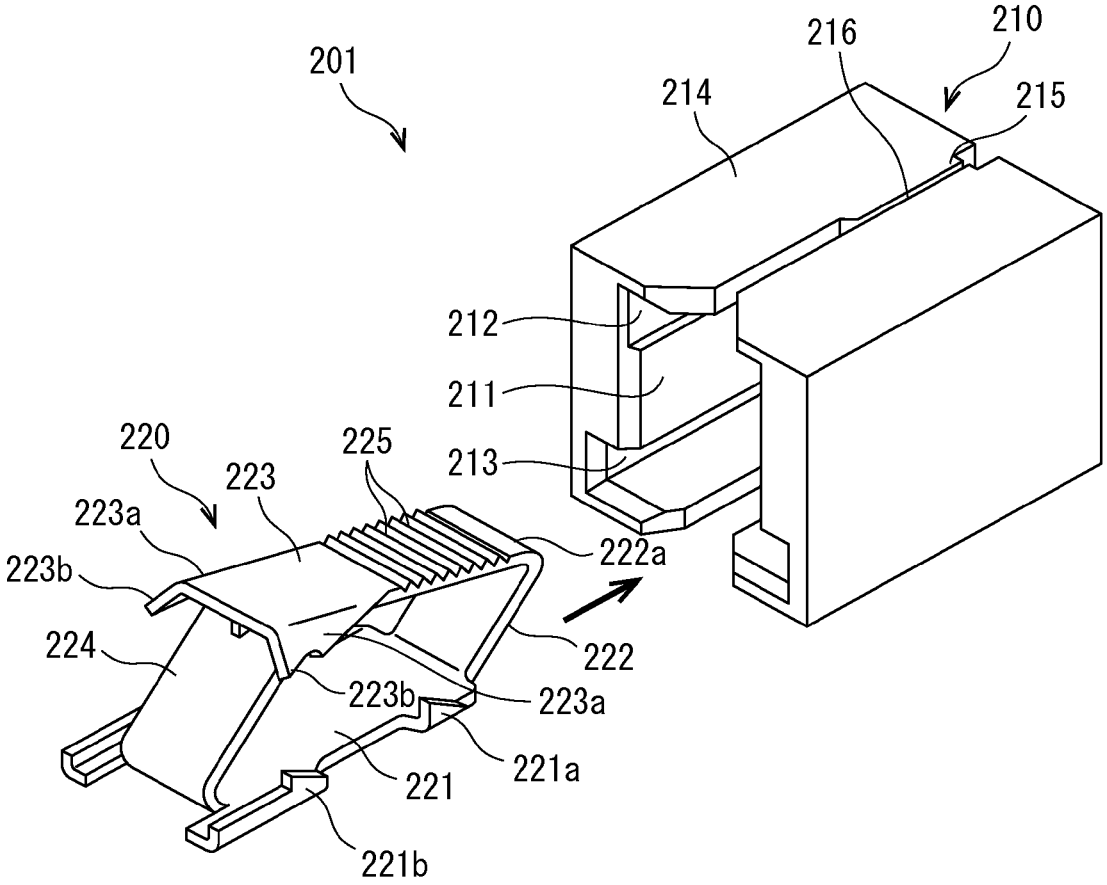
FIG. 13 is a perspective view of another known electrical connector.
Figure 14:
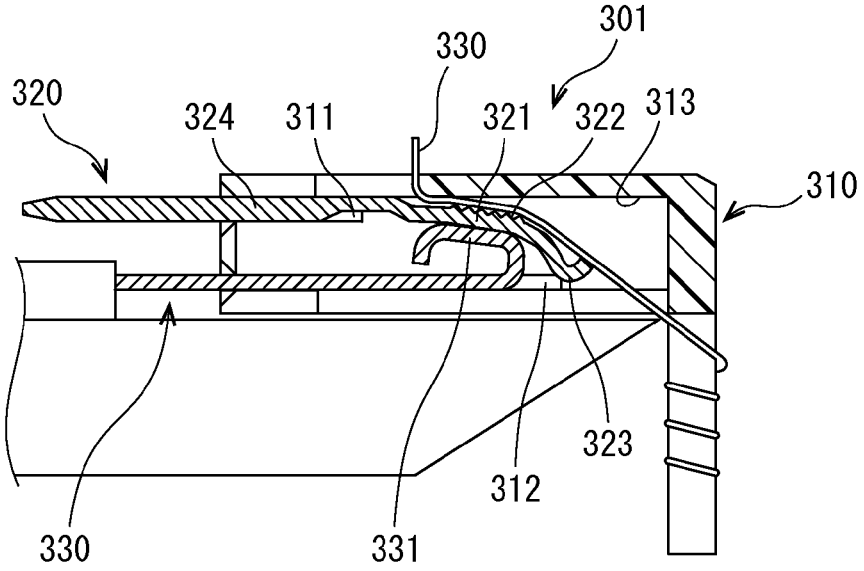
FIG. 14 is a cross-sectional view of another known electrical connector.

The electrical terminal 1 shown in FIG. 9 and FIG. 10 has the same basic structure as that of the electrical terminal 1 shown in FIG. 1 to FIG. 6. In FIG. 9 and FIG. 10, the plurality of serrations are not illustrated. However, the electrical terminal 1 shown in FIG. 9 and FIG. 10 differs from the electrical terminal 1 shown in FIG. 1 to FIG. 6 in that a lock 50, to be locked when the second member 20 is mated with the pair of connecting face portions 11, is provided on the pair of connecting face portions 11 and the second member 20.

Herein, the lock 50 includes a pair of locking protrusions 51 formed in a protruding manner at upper-end edges of the pair of connecting face portions 11, respectively, and a locking opening 52 formed in the flat plate portion 21 of the second member 20. When the second member 20 is mated with the pair of connecting face portions 11, the pair of locking protrusions 51 are inserted into the locking opening 52. A tapered portion 51*a* is disposed on the upper-end outer side face of each of the locking protrusions 51. This assists insertion of the pair of locking protrusions 51 into the locking opening 52 with ease. Then, when the pair of locking protrusions 51 are inserted into the locking opening 52, the locking protrusions 51 abut against the edges of the locking opening 52 in the width direction. This prevents the pair of connecting face portions 11 from opening. Therefore, the pair of connecting face portions 11 are prevented from opening when the second member 20 is mated with the pair of connecting face portions 11. It is thus possible to avoid the wire 40 from being discontinuous.

Moreover, the electrical terminal 1 shown in FIG. 9 and FIG. 10 also differs from the electrical terminal 1 shown in FIG. 1 to FIG. 6 in that a mating portion 60 to be mated with a mating connector (not shown) is disposed at the coupling portion 12 of the first member 10.

More specifically, in the electrical terminal 1 shown in FIG. 9 and FIG. 10, the mating portion 60 is tab shaped and connects at the connecting portion 12*c* through a coupling piece 61. The mating portion 60 is folded downward through the coupling piece 61, and is configured to be mated with an electrical terminal (not illustrated) of the mating connector.

Although the exemplary embodiment of the invention has been disclosed for illustrative purposes, those skilled in the art will appreciate that various modifications, additions and substitutions are possible, without departing from the scope and spirit of the invention as disclosed in the accompanying claims.

For example, the inner faces 11*a* facing each other are not necessarily formed to be curved outward from the narrower-gap side of the inner faces 11*a* facing with each other to the wider-gap side.

Moreover, in the electrical terminal 1, the coupling portion 12 of the first member 10 and the second member 20 may be not connected using the coupling member 30.

Moreover, in the electrical terminal 1, it may not necessary that the tapered portions 11*d* and 22*a* that guide respective counterparty members are provided on the outer faces of the ends of the pair of connecting face portions 11 on the wider-gap side of the inner faces 11*a* and on the inner faces of the ends of the second member 20.

In the electrical terminal 1, it may not be necessary that the plurality of serrations 11*b* and 11*c* formed on the respective faces 11*a* extend in directions intersecting with each other.

Furthermore, it may not be necessary that the coupling portion 12 includes the first curved portion 12*a*, the second curved portion 12*b*, and the connecting portion 12*c* as long as the coupling portion 12 couples the pair of connecting face portions 11 together.

What is claimed is:

1. An electrical terminal comprising:

a first member having a pair of connecting face portions facing each other in a substantially V shape such that a gap between inner faces of the pair of connecting face portions gradually becomes smaller from a wider-gap side to a narrower-gap side, a coupling portion connecting the pair of connecting face portions at ends of the narrower-gap side of the inner faces, and a plurality of serrations disposed on the pair of inner faces and extending at intersecting directions; and a second member having a substantially U shape to mate with the pair of connecting face portions from the wider-gap side of the inner faces and displace outer side faces of the pair of connecting face portions inward, urging the inner faces toward each other.

2. The electrical terminal according to claim 1, wherein the first member includes a wire receiving section disposed between the pair of connecting face portions.

3. The electrical terminal according to claim 1, wherein the inner faces extend outward from the narrower-gap side to the wider-gap side of the inner faces.

4. The electrical terminal according to claim 3, wherein the inner faces curve outward from the narrower-gap side to the wider-gap side.

5. The electrical terminal according to claim 1, wherein the coupling portion and the second member are coupled by a coupling member.

6. The electrical terminal according to claim 1, further comprising first tapered portions disposed on outer faces of the ends of the pair of connecting face portions.

7. The electrical terminal according to claim 6, further comprising second tapered portions disposed on an inner surface of the second member to engage the first tapered portions.

8. The electrical terminal according to claim 1, wherein the coupling portion includes a first curved portion that curves outward from an end of a first face portion of the pair of connecting face portions.

9. The electrical terminal according to claim 8, wherein the coupling portion further includes a second curved portion that curves outward from an end of a second face portion of the pair of connecting face portions.

10. The electrical terminal according to claim 9, wherein the coupling portion further includes a connecting portion connecting the end of the first curved portion with the end of the second curved portion.

11. The electrical terminal according to claim 1, further comprising a lock disposed on the pair of connecting face portions and on the second member securing the first member and the second member when the second member is mated with the pair of connecting face portions.

12. The electrical terminal according to claim 11, wherein the lock includes a pair of locking protrusions disposed along upper-end edges of the pair of connecting face portions and a locking opening disposed along the second member.

13. The electrical terminal according to claim 12, further comprising a tapered portion disposed on each upper-outer side face of each of the pair of locking protrusions.

14. The electrical terminal according to claim 1, wherein the coupling portion includes a mating portion to be mated with a mating connector.

* * * * *